US008523536B2

(12) United States Patent
Kuwabara et al.

(10) Patent No.: US 8,523,536 B2
(45) Date of Patent: Sep. 3, 2013

(54) AXIAL PISTON PUMP, AND POWER TRANSMISSION DEVICE WITH AXIAL PISTON PUMP

(75) Inventors: Shinya Kuwabara, Susono (JP); Tadashi Fujiyoshi, Susono (JP); Hiroyuki Shiori, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 1197 days.

(21) Appl. No.: 12/201,113

(22) Filed: Aug. 29, 2008

(65) Prior Publication Data

US 2009/0060765 A1 Mar. 5, 2009

(30) Foreign Application Priority Data

Aug. 31, 2007 (JP) ..... 2007-225090

(51) Int. Cl.
*F04B 1/26* (2006.01)

(52) U.S. Cl.
USPC ..... 417/222.1; 417/218; 417/212; 417/271; 417/269; 417/462; 74/56; 74/568 R

(58) Field of Classification Search
USPC ..... 417/218, 222.1, 462, 212, 269, 271; 74/56, 839, 568; 92/12.2, 13; 91/504
See application file for complete search history.

(56) References Cited

U.S. PATENT DOCUMENTS

| | | | | |
|---|---|---|---|---|
| 2,107,079 | A * | 2/1938 | Mentele | 74/568 R |
| 2,143,935 | A * | 1/1939 | Chandler | 91/474 |
| 2,283,242 | A * | 5/1942 | Van Der Walt | 74/839 |
| 2,344,565 | A * | 3/1944 | Scott et al. | 92/12.2 |
| 3,034,363 | A * | 5/1962 | Vogel | 74/55 |
| 3,063,306 | A * | 11/1962 | Jeffrey | 74/568 R |
| 7,331,272 | B2 | 2/2008 | Forster | |
| 7,771,175 | B2 * | 8/2010 | Ota et al. | 417/269 |
| 2008/0051251 | A1 * | 2/2008 | Ogata et al. | 477/52 |

FOREIGN PATENT DOCUMENTS

JP 2006-233972 9/2006

* cited by examiner

*Primary Examiner* — Charles Freay
*Assistant Examiner* — Christopher Bobish
(74) *Attorney, Agent, or Firm* — Oblon, Spivak, McClelland, Maier & Neustadt, L.L.P.

(57) ABSTRACT

An axial piston pump has: a cylinder body that forms therein a cylinder chamber extending in an axial direction of a drive shaft and rotates integrally with a driven shaft; a piston that reciprocates in the axial direction of the drive shaft; and a cam device that rotates integrally with the drive shaft and has: a fixed cam member that has a cam surface capable of coming into contact with a cam follower coupled to the piston and is capable of rotating integrally with the drive shaft, with movement of the fixed cam member in the axial direction being restricted; and a movable cam member that has a cam surface capable of coming into contact with the cam follower and is capable of rotating integrally with the drive shaft, with movement of the movable cam member in the axial direction being allowed, irregularity differences in the axial direction of the cam surface of the fixed cam member and the movable cam member being different from each other.

20 Claims, 12 Drawing Sheets

AXIAL PISTON PUMP, AND POWER TRANSMISSION DEVICE WITH AXIAL PISTON PUMP

INCORPORATION BY REFERENCE

The disclosure of Japanese Patent Application No. 2007-225090 filed on Aug. 31, 2007, including the specification, drawings and abstract is incorporated herein by reference in its entirety.

BACKGROUND OF THE INVENTION

1. Field of the Invention

This invention relates to an axial piston pump capable of reciprocating a piston provided in a cylinder chamber in an axial direction of a drive shaft by using cam device capable of rotating integrally with the drive shaft. The invention also relates to a power transmission device having the axial piston pump.

2. Description of the Related Art

There is a conventional multi-stroke type axial piston pump, which has cam members having cam surfaces facing in an axial direction of a drive shaft and rotating integrally with the drive shaft, and in which roller rolling on the cam surfaces are supported to pistons reciprocating in the axial direction (see Japanese Patent Application Publication No. 2006-233972 (JP-A-2006-233972)).

The shape of each cam surface of the cam member of the pump disclosed in JP-A-2006-233972 is constant, and the pump capacity cannot be changed due to a constant stroke quantity of the pistons. Therefore, the pump disclosed in JP-A-2006-233972 is not suitable for changing the pump capacity depending on the situation.

However, when such a pump is incorporated in an automatic transmission of a vehicle such as an automobile, and the input side and the output side of a power transmission path are connected to a drive shaft and a driven shaft of the pump, respectively, to drive the pump by means of a rotational difference between the input side and the output side, the flow rate of oil suctioned by the pump increases and thereby the suction resistance of the oil increases due to a significant rotational difference between the input side and the output side upon startup from rest, which might impede the rollers from following the cam surface. Therefore, it is desired to change this configuration in accordance with the situation of the pump capacity and prevent the increase of the flow rate of the oil suctioned by the pump.

SUMMARY OF THE INVENTION

Therefore, this invention provides an axial piston pump capable of changing the pump capacity, and a power transmission device for a vehicle which has this pump.

Therefore, according to an aspect of this invention, an axial piston pump that generates hydraulic pressure by means of rotational power input from a drive shaft is provided. This axial piston pump has: a cylinder body that forms a cylinder chamber extending in an axial direction of the drive shaft and rotates integrally with a driven shaft; a piston that is inserted into the cylinder chamber and reciprocates in the axial direction of the drive shaft in the cylinder chamber; and a cam device. This cam device rotates integrally with the drive shaft and has: a fixed cam member that has a cam surface capable of coming into contact with a cam follower coupled to the piston and is capable of rotating integrally with the drive shaft, with movement of the fixed cam member in the axial direction being restricted; and a movable cam member that has a cam surface capable of coming into contact with the cam follower and is capable of rotating integrally with the drive shaft, with movement of the movable cam member in the axial direction being allowed, an irregularity difference in the axial direction of the cam surface of the fixed cam member and an irregularity difference in the axial direction of the cam surface of the movable cam member being different from each other.

According to this axial piston pump, the stroke quantity of the piston can be changed by separately using the fixed cam member and the movable cam member that have different irregularity differences on the respective cam surfaces. Accordingly the pump capacity can be changed depending on the situation. Since the fixed cam member is restricted in moving in the axial direction, a stroke of the piston corresponding to the cam surface of the fixed cam member can be secured even when the movable cam member can no longer move for any reason.

Also, according to another aspect of the invention, a power transmission device that is provided within a power transmission path extending from a power source for traveling of a vehicle to a drive wheel is provided. This power transmission device has: a drive shaft to which one of an output side and an input side of the power transmission path is connected; a driven shaft that is disposed coaxially with the driven shaft and to which the other one of the output side and the input side of the power transmission path is connected; a cam device that rotates integrally with the drive shaft; a cylinder body that forms therein a cylinder chamber extending in the axial direction of the drive shaft and integrally rotates with the driven shaft; a piston that is inserted into the cylinder chamber and reciprocates; an axial piston pump that is capable of reciprocating the piston with respect to the axial direction by means of the cam device and discharging fluid suctioned into the cylinder chamber from the cylinder chamber. The cam device has: a fixed cam member that has a cam surface capable of coming into contact with a cam follower coupled to the piston and is capable of rotating integrally with the drive shaft, with movement of the fixed cam member in the axial direction being restricted; a movable cam member that has a cam surface capable of coming into contact with the cam follower and is capable of rotating integrally with the drive shaft, with movement of the movable cam member in the axial direction being allowed; and a cam effecting device that uses the fluid discharged from the cylinder chamber to change over between a restrained state where the movable cam member is restrained to an effective position with respect to the axial direction, in which the cam follower can follow the cam surface of the movable cam member, and a release state where the restraint of the movable cam member to the effective position is released. The axial piston pump is characterized in that an irregularity difference in the axial direction of the cam surface of the fixed cam member is smaller than an irregularity difference in the axial direction of the cam surface of the movable cam member.

According to this power transmission device, since the axial piston pump is interposed between the output side and input side of the power transmission path, the pump can be driven by the rotational difference between the input side and the output side to suction or discharge the oil. The cam device provided in this pump has the fixed cam member and the movable cam member that have different irregularity differences on the respective cam surfaces so that these cam members can be used separately depending on the traveling condition of the vehicle and the condition of the power source for traveling. In such a circumstance as the startup of the vehicle, where the rotational difference between the input side and the output side is significant, the flow rate of the oil suctioned by the pump can be prevented from increasing by reducing the pump capacity, whereby followability of the cam follower relative to the cam surface can be secured. At the time of steady traveling, the rotational difference between the input side and the output side can be reduced by increasing the pump capacity, preventing the energy loss in the pump. Furthermore, even in the case where the cam effecting device cannot readily obtain the hydraulic pressure to be used immediately after starting up the power source, the fixed cam member having a small irregularity difference on the cam surface thereof is made effective automatically. When it is difficult to obtain the hydraulic pressure, the rotational difference between the input side and the output side is significant when the vehicle is stopped. Therefore, making the fixed cam member having a small irregularity difference on the cam surface thereof effective can secure the followability of the cam follower relative to the cam surface even in this kind of situation.

As described above, according to this invention, the stroke quantity of the piston can be changed by separately using the fixed cam member and the movable cam member that have different irregularity differences on the respective cam surfaces. As a result, the pump capacity can be changed according to the situation.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF THE EMBODIMENTS

Example embodiments of the present invention will be described in greater detail below with reference to the accompanying drawings.

Figure 1:
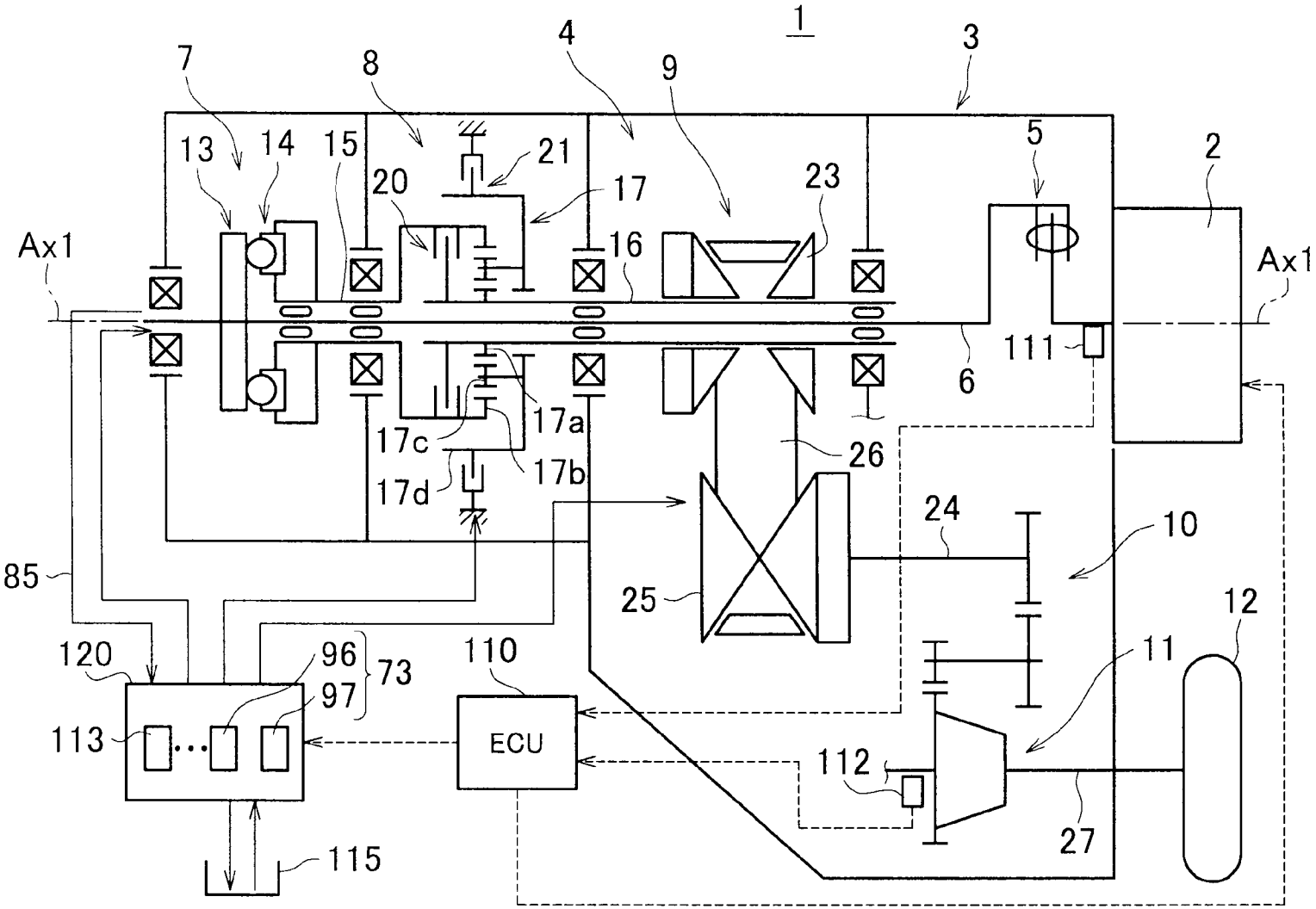
FIG. 1 is a skeleton diagram showing simplified power transmission path and other elements of a vehicle which is provided with a power transmission device incorporated with a pump related to an embodiment of the invention.

FIG. 1 is a skeleton diagram showing simplified power transmission path and other elements of a vehicle which is provided with a power transmission device incorporated with an axial piston pump related to an embodiment of the invention. A vehicle 1 is provided with an internal combustion engine 2 as its power source for traveling. An output torque of the internal combustion engine 2 is input to a power transmission device 4 accommodated in a casing 3 and then transmitted to a drive wheel 12 after gear change and other various operations are performed. The power transmission device 4 is configured such that a torque transmitted to an input shaft 6 via a damper mechanism 5 is transmitted to the drive wheel 12 via a pump 7, forward/reverse change-over device 8, continuously variable transmission 9, transmission device 10 and final reduction gear 11. The vehicle 1 is provided with an electronic control unit (ECU) 110 functioning as a computer for controlling the entire vehicle 1, and a hydraulic control device 120 for controlling hydraulic pressure element of the power transmission device 4 on the basis of an output signal from the ECU 110.

The pump 7 functions as both an oil pump function serving as a hydraulic pressure source, and a power transmission function serving as a starting device of the vehicle 1. The pump 7 is configured as a multi-stroke type axial piston pump which is capable of reciprocating a piston 14 with respect to a direction of axis Ax1 of the input shaft 6 by means of a cam unit 13 serving as cam means capable of rotating integrally with the input shaft 6 serving as a drive shaft, and reciprocating the piston 14 at least twice at each rotation of the cam unit 13. The rotation of the piston 14 is transmitted to a hollow connecting drum 15 that is coaxially provided outside the input shaft 6.

The forward/reverse change-over device 8 is interposed between the connecting drum 15 and a primary shaft 16 of the continuously variable transmission 9 and changes over the rotation direction of the primary shaft 16 between a normal rotation direction and a reverse rotation direction. The forward/reverse change-over device 8 has a planetary gear mechanism 17. The planetary gear mechanism 17 has a sun gear 17*a* that integrally rotates with the primary shaft 16, a ring gear 17*b* that is provided coaxially with the sun gear 17*a*, a pinion 17*c* that is meshed with these gears 17*a*, 17*b*, and a carrier 17*d* that holds the pinion 17*c* around the sun gear 17*a* so that the pinion 17*c* can rotate and revolve around the sun gear 17*a*. The forward/reverse change-over device 8 further has a clutch 20 that connects the sun gear 17*a* and the ring gear 17*b* to each other or releases the connection, and a braking device 21 that inhibits rotation of the carrier 17*d* and releases the inhibition of the rotation. The forward/reverse change-over device 8 changes over the rotation direction of the primary shaft 16 to the normal rotation direction by connecting the sun gear 17*a* and the ring gear 17*b* to each other by the clutch 20, with the braking device 21 allowing the carrier 17*d* to rotate, and changes over the rotation direction of the primary shaft 16 to the reverse rotation direction by releasing the connection between the sun gear 17*a* and the ring gear 17*b* by the clutch 20, with the braking device 21 inhibiting the rotation of the carrier 17*d*.

The continuously variable transmission 9 is configured as a conventional continuously variable transmission that uses a belt. The continuously variable transmission 9 changes the groove width of a primary pulley 23 that rotates integrally with the primary shaft 16 and the groove width of a secondary pulley 25 that orates integrally with a secondary shaft 24 connected to the transmission device 10 to change the winding diameter of a belt 26 wound between the pulleys 23, 25. Consequently, the rotational speed ratio between the primary shaft 16 and the secondary shaft 24 can be changed continuously. The rotation that is output from the continuously variable transmission 9 is decelerated by the transmission device 10 and thereafter by the final reduction gear 11, and then output to a drive shaft 27 coupled to the drive wheel 12.

Figure 2:
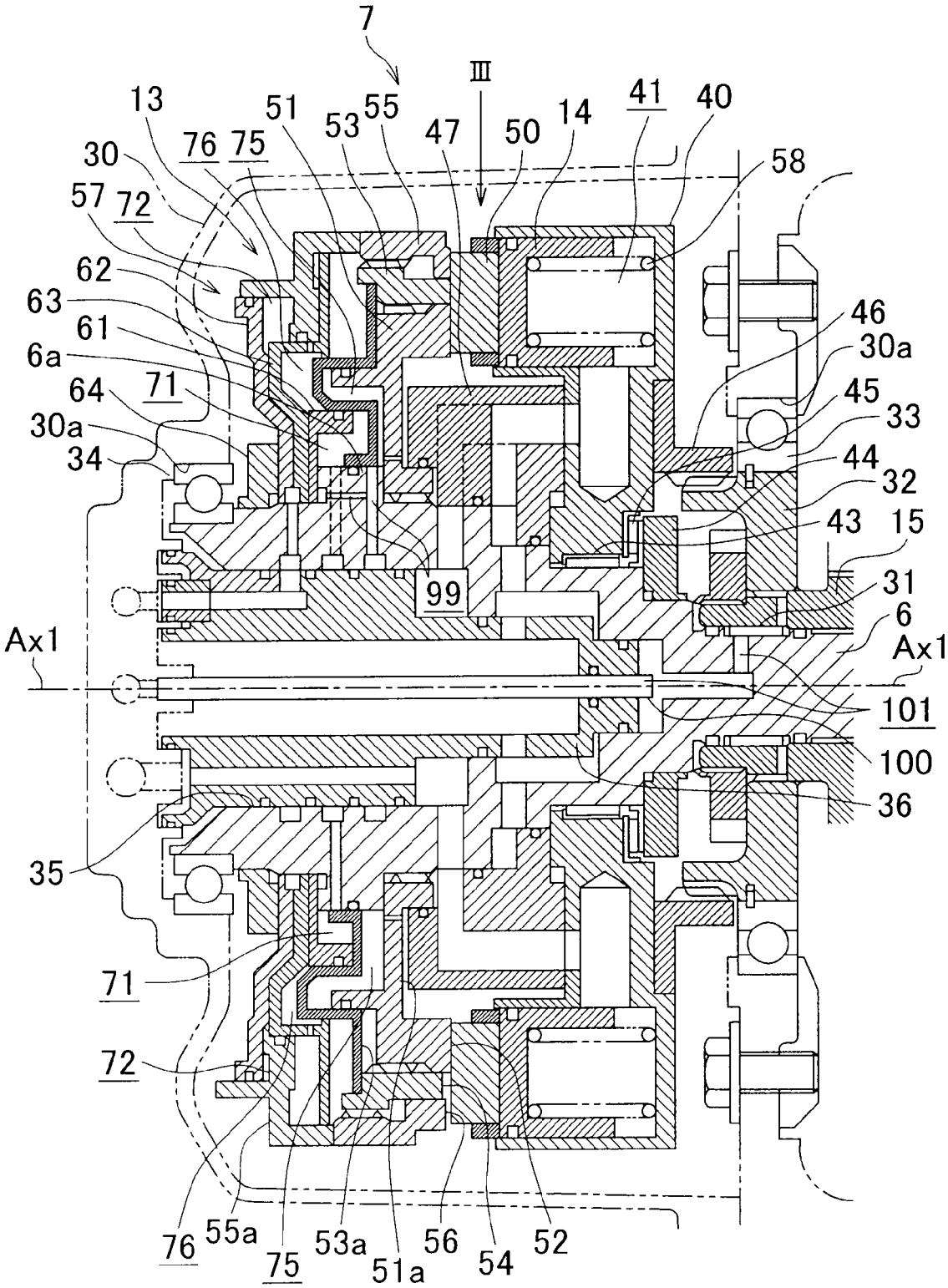
FIG. 2 is a vertical cross-sectional view showing a substantial part of the pump of FIG. 1.

Next, the pump 7 shown in FIG. 1 is described in detail with reference to FIGS. 2 to 12. FIG. 2 is a vertical cross-sectional view showing a substantial part of the pump 7. Note that FIG. 2 illustrates a cross section of the characterizing parts of elements of the pump 7, wherein the positions of movable elements of the pump 7 differ between the upper half and the lower half of the diagram with respect to the direction of the axis Ax1 because these movable elements are shown in one diagram.

As shown in FIG. 2, the pump 7 has a pump housing 30 that accommodates elements such as the cam unit 13 and the piston 14. In the pump housing 30 the input shaft 6 and the connecting drum 15 are supported coaxially so as to be able to rotate freely. The input shaft 6 and the connecting drum 15 are joined coaxially to each other with a bearing 31 interposed therebetween, so as to be rotatable relative to each other as shown on the right side of FIG. 2. An interposed member 32 is spline-coupled to the outer periphery of the connecting drum 15 and mounted on this connecting drum 15 so as to be rotatable integrally therewith. This interposed member 32 is supported rotatably to an opening 30*a* of the pump housing 30 via a bearing 33. The input shaft 6 is configured as a stepped shaft the outer diameter of which increases in a stepwise fashion toward the left-hand side of FIG. 2, and an oil hole 35 that extends in the direction of the axis Ax1 (called "axial direction" hereinafter) and is opened leftward is formed in the center of the input shaft 6. A guide piece 36 in the form of a stepped shaft for guiding oil to a predetermined position is coaxially fitted in the oil hole 35. Note that the oil is supplied, as lubricant oil, between the input shaft 6 and the connecting drum 15 by supply paths 101. The supply paths 101 are configured by both a supply pipe 100 inserted into the center of the guide piece 36 and the oil hole 35 of the input shaft 6. The oil that is supplied as lubricant oil is led to each part of the power transmission device 4.

The cam unit 13 is provided on the outer periphery of the input shaft 6 so as to be rotatable integrally with the input shaft 6. The piston 14 which is driven by the cam unit 13 is inserted into a cylinder chamber 41 of a cylinder body 40 so as to be reciprocable, the cylinder body 40 being disposed coaxially with the input shaft 6. Between the cam unit 13 and the cylinder body 40, a rotary valve 47 for changing over between suction and discharge of the oil from and to the cylinder chamber 41 is mounted on the outer periphery of the input shaft 6. A bearing 43 that bears the radial load is interposed between the cylinder body 40 and the input shaft 6. A collar 44 which projects up to a part of a side surface of the cylinder 40 is mounted on the input shaft 6, and a bearing 45 which bears the axial load is interposed between the collar 44 and the side surface of the cylinder body 40. The cylinder body 40 is made rotatable relative to the input shaft 6 by means of these bearings 43, 45. The cylinder body 40 has a projecting part 46 that projects from the side surface of the cylinder body 40 to the right-hand side of FIG. 2. This projecting part 46 is spline-coupled to the interposed member 32 rotating integrally with the connecting drum 15. Therefore, the cylinder body 40 can rotate integrally with the connecting drum 15 while being to rotate relative to the input shaft 6.

Figure 3:
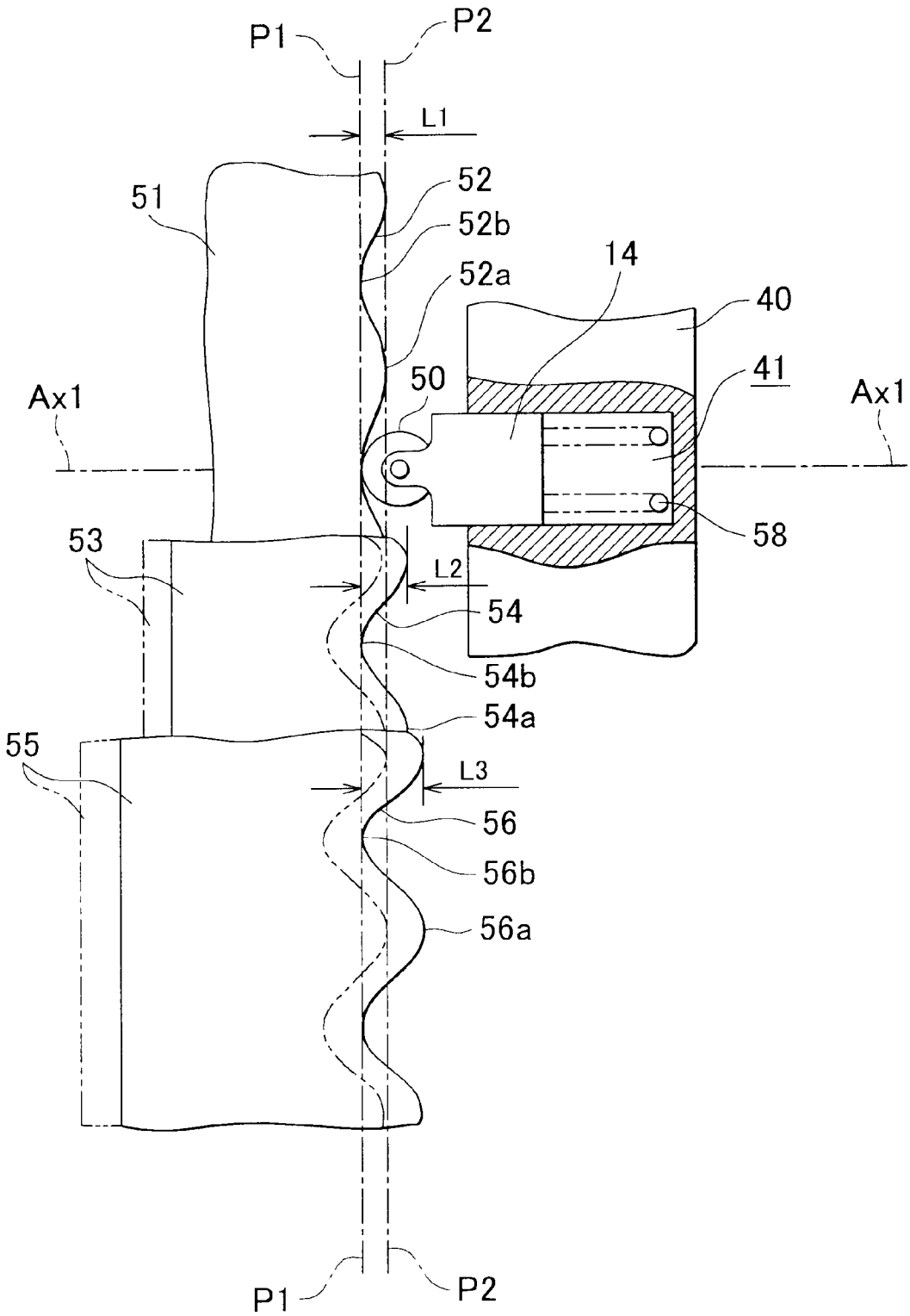
FIG. 3 is an explanatory diagram taken along a direction of arrow III shown in FIG. 2.

FIG. 3 is an explanatory diagram taken along a direction of arrow III shown in FIG. 2. As shown in FIG. 2 and FIG. 3, the cam unit 13 has: a fixed cam member 51 which has a cam surface 52 capable of coming into contact with a roller 50 serving as a cam follower coupled rotatably to the piston 14 and is restricted in moving in the axial direction; a first movable cam member 53 which has a cam surface 54 capable of coming into contact with the roller 50 and is capable of moving in the axial direction; a second movable cam member 55 which has a cam surface 56 capable coming into contact with the roller 50 and is capable of moving in the axial direction; and a moving device 57 which is capable of moving the two cam members 53, 55 separately to predetermined positions in the axial direction and restraining these cam members 53, 55 to these positions. Also, an urging member 58, such as a coil spring, for urging the roller 50 to the cam surfaces 52, 54, 55 is provided within the cylinder chamber 41 in order to cause the roller 50 to follow each of the cam members 51, 53, 55. These cam members 51, 53, 55 are disposed coaxially, with the fixed cam member 51 being disposed on the innermost side, the second movable cam member 55 on the outermost side, and the first movable cam member 53 therebetween.

As shown in FIG. 2, the fixed cam member 51 is spline-coupled to the outer periphery of the input shaft 6 so as to be unrotatable relative to the input shaft 6, and rotates integrally with the input shaft 6. A projecting part 6*a* of the input shaft 6, which projects radially outward, restricts the fixed cam member 51 in moving to be apart from the piston 14 in the axial direction, i.e., toward the left-hand side of FIG. 2. The fixed cam member 51 is also press-fitted onto the outer periphery of the input shaft 6 so that it is restricted in moving toward the right-hand side of FIG. 2 as well. Note that the fixed cam member 51 may be restricted in moving in the axial direction by providing the input shaft 6 with a snap ring or a collar. The first movable cam member 53 is spline-coupled to the fixed cam member 51 in a state in which the first movable cam member 53 is allowed to move in the axial direction, so as to be able to rotate integrally with the input shaft 6. Also, the second movable cam member 55 is spline-coupled to the first movable cam member 53 in a state in which the second movable cam member 55 is allowed to move in the axial direction, so as to be able to rotate integrally with the input shaft 6.

As shown in FIG. 3, an irregularity difference with respect to the axial direction of the cam surface 52 of the fixed cam member 51, that is, a lifted amount L1, is smaller than lifted amounts L2, L3 of the other cam members 53, 55. In addition, the lifted amount L2 of the first movable cam member 53 is smaller than the lifted amount L3 of the second movable cam member 55. Therefore, a relationship of L1<L2<L3 is established among these lift amounts L1 to L3. The stroke quantity of the piston 14 can be changed, accordingly, by appropriately selecting a cam member from these three cam members 51, 53, 55 to push the roller 50 (piston 14) in. In other words, the capacity of the pump 7 can be changed.

In order to push the roller 50 in by means of the cam member or, in other words, in order to make the cam member effective, this specific cam member needs to be restrained to a predetermined position with respect to the axial direction. In this regard, since the fixed cam member 51 is restricted in moving in the axial direction, the fixed cam member 51 is automatically made effective by not restraining the other movable cam members 53, 55 to their positions (see the section below the axis Ax1 shown in FIG. 2).

The moving range of the first movable cam member 53 is set so that it can move between a position on a virtual line where the apex 54*a* of the cam surface 54 is on a position P2 of the apex 52*a* of the cam surface 52 of the fixed cam member 51 or recedes from the position P2, and a position on a solid line where the lowermost part 54*b* of the cam surface 54 is on a position P1 of the lowermost part 52*b* of the cam surface 52 or moves forward of the position P1. In the moving range of the first movable cam member 53, the receding movement thereof is restricted by a stopper 61 which is provided coaxially with the input shaft 6 so as not to be movable in the axial direction, while the forward movement of the first movable cam member 53 is restricted by the fixed cam member 51, as shown in FIG. 2. The moving range of the second movable cam member 55 is also set, as shown in FIG. 3, so that it can move between a position on a virtual line where the apex 56*a* of the cam surface 56 is on the position P2 or recedes from the position P2, and a position on the solid line where the lowermost part 56*b* of the cam surface 56 is on the position P1 or moves forward of the position P1. In the moving range of the second movable cam member 55, the receding movement thereof is restricted by a stopper 62 which is provided coaxially with the input shaft 6 so as not to be movable in the axial direction, while the forward movement of the second movable cam member 55 is restricted by a stopper 63 which is provided coaxially with the input shaft 6 between the stopper 61 and the stopper 63 so as not to be movable in the axial direction, as shown in FIG. 2. These stoppers 61 to 63 are held between the projecting part 6*a* of the input shaft 6 and a collar 64 mounted on the input shaft 6, and thus are inhibited from moving in the axial direction.

The moving device 57 is operated using hydraulic pressure and has: a first control chamber 71 for moving and restraining the first movable cam member 53 to a position shown by a solid line in FIG. 3; a second control chamber 72 for moving and restraining the second movable cam member 55 to a position shown in FIG. 3; and an oil pressure regulator 73 (see FIG. 1) for regulating hydraulic pressure (pressure) of oil guided to each of the control chambers 71, 72 as working oil. Here, the oil corresponds to the fluid associated with this invention and the oil pressure regulator 73 to a pressure regulator associated with this invention. The first control chamber 71 is provided in a region surrounded by the first movable cam member 53, the stopper 61 and the input shaft 6. The second control chamber 72 is provided in a region surrounded by the second movable cam member 55, the stopper 62 and the stopper 63. As shown in FIG. 1, the oil pressure regulator 73 as a part of the components of the hydraulic control device 120 controlling hydraulic pressure of each part of the power transmission device 4. Appropriate operation of the oil pressure regulator 73 provided in the hydraulic control device 120 allows individual adjustment of the hydraulic pressure of the oil guided to each of the control chambers 71, 72. A flow of oil of the moving device 57 having the oil pressure regulator 73 is described hereinafter along with the description of a flow of oil suctioned and discharged by the pump 7.

Figure 4:
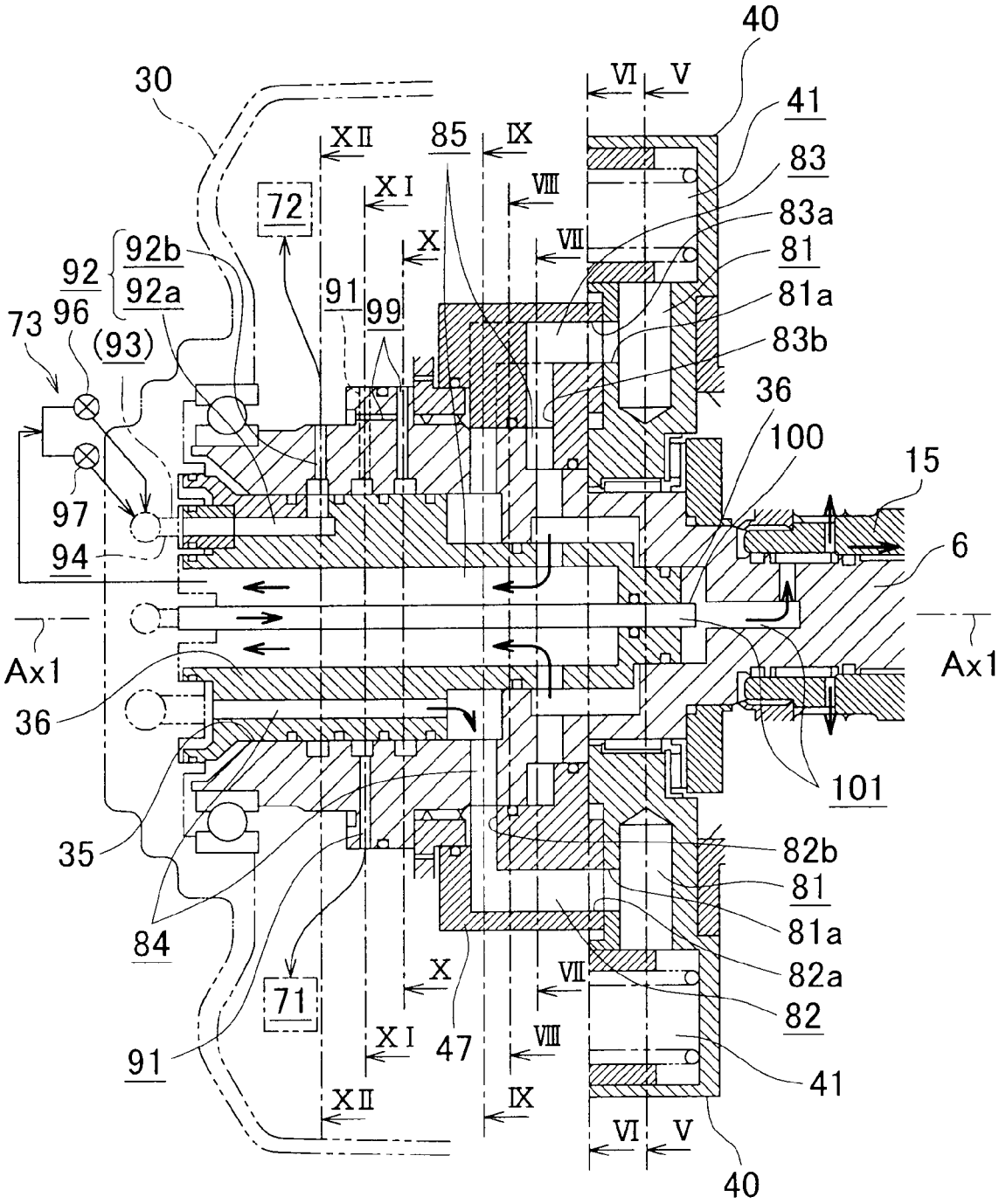
FIG. 4 is a vertical cross-sectional view showing an element of the pump relating to a flow of lubricant oil, the element being shown in FIG. 2.

FIG. 4 is a vertical cross-sectional view showing an element of the pump 7 relating to a flow of the oil, the element being shown in FIG. 2. FIGS. 5 to 12 are horizontal cross-sectional views showing cross sections taken along line V-V, line VI-VI, line VII-VII, line VIII-VIII, line IX-IX, line X-X, line XI-XI, and line XII-XII of FIG. 4, respectively. Note that the flow of the oil is shown by the arrowed lines in these drawings.

Figure 5:
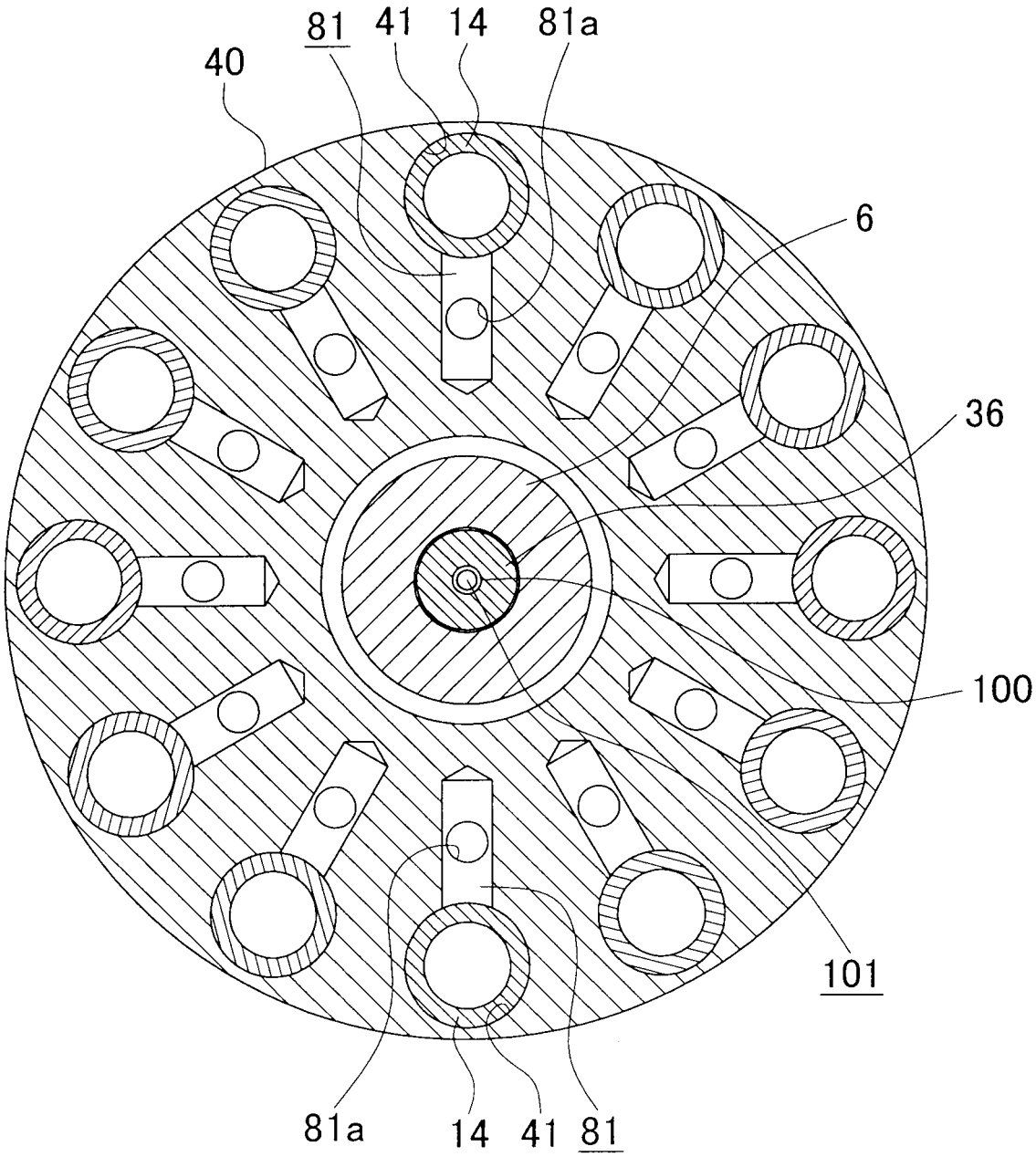
FIG. 5 is a horizontal cross-sectional view showing a cross section taken along line V-V of FIG. 4.
Figure 6:
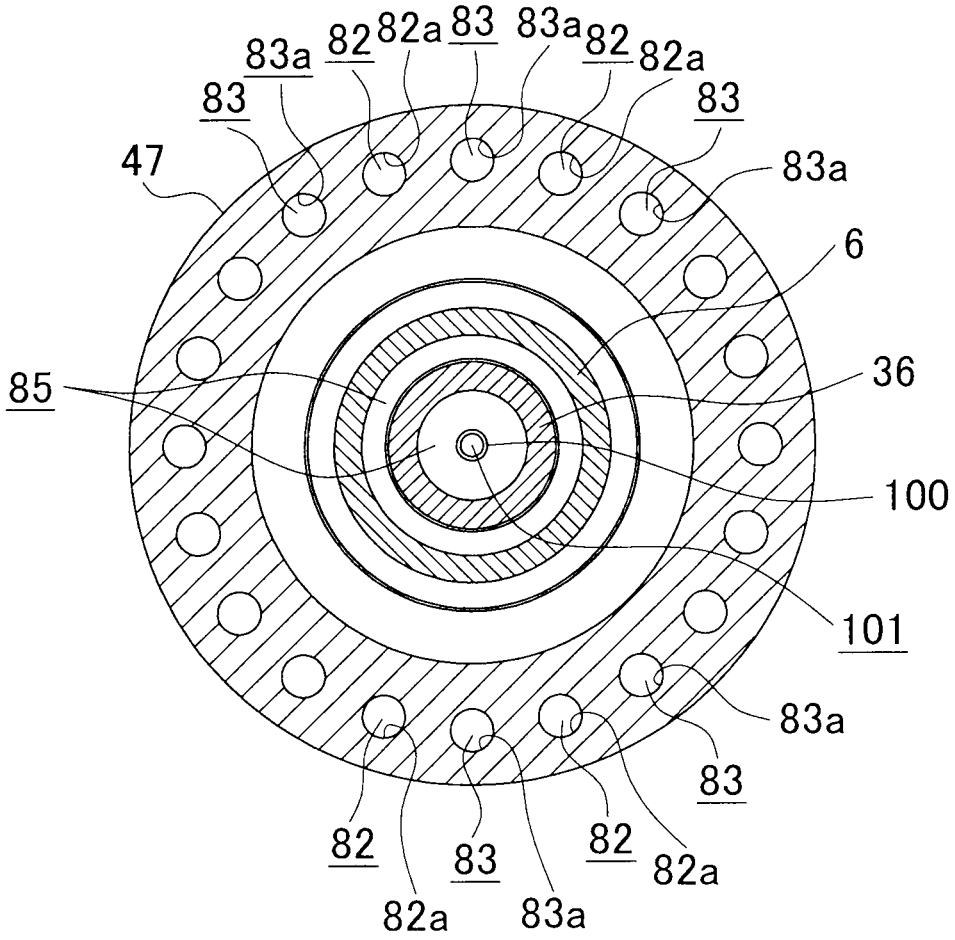
FIG. 6 is a horizontal cross-sectional view showing a cross section taken along line VI-VI of FIG. 4.
Figure 7:
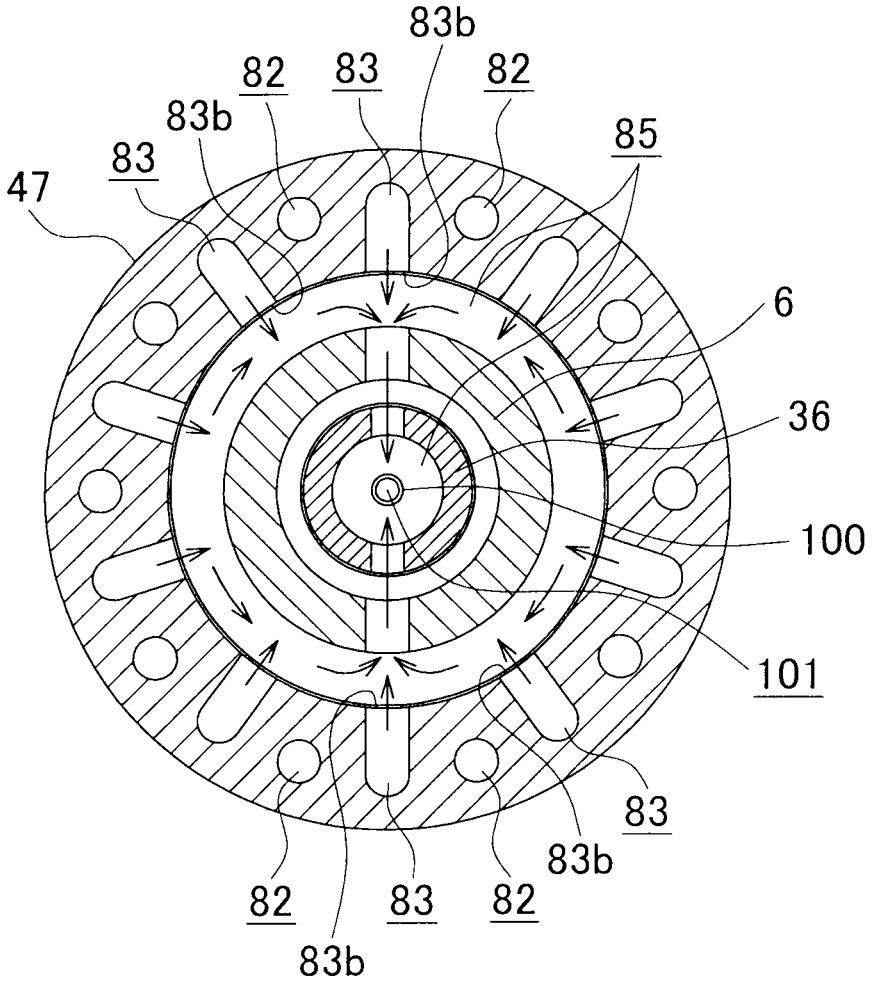
FIG. 7 is a horizontal cross-sectional view showing a cross section taken along line VII-VII of FIG. 4.
Figure 8:
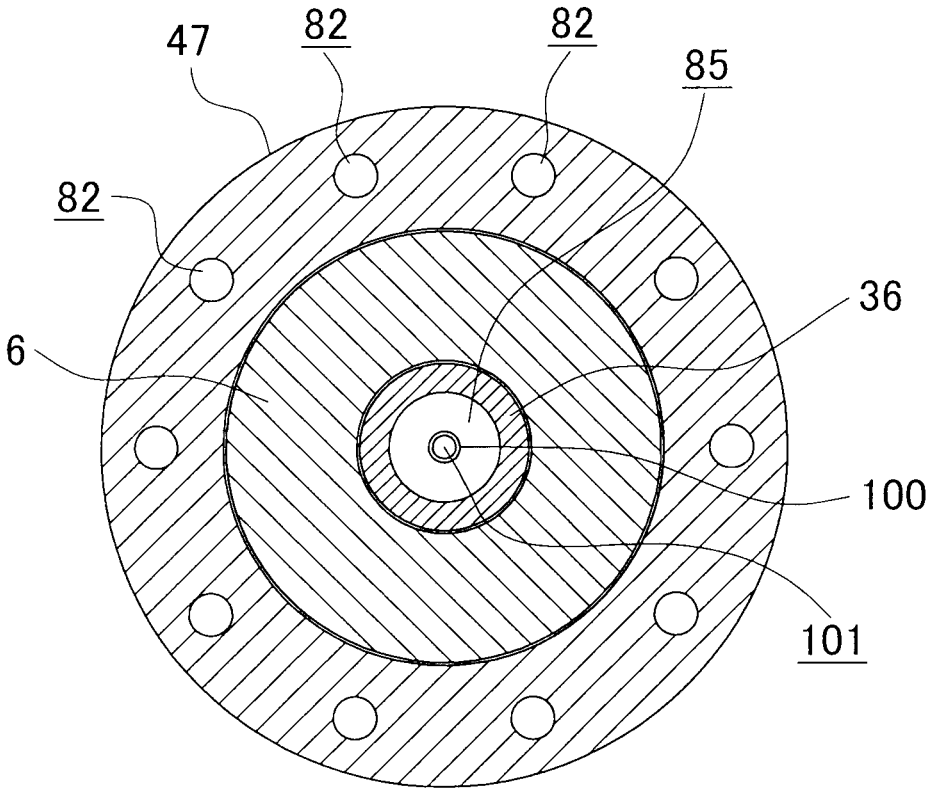
FIG. 8 is a horizontal cross-sectional view showing a cross section taken along line VIII-VIII of FIG. 4.
Figure 9:
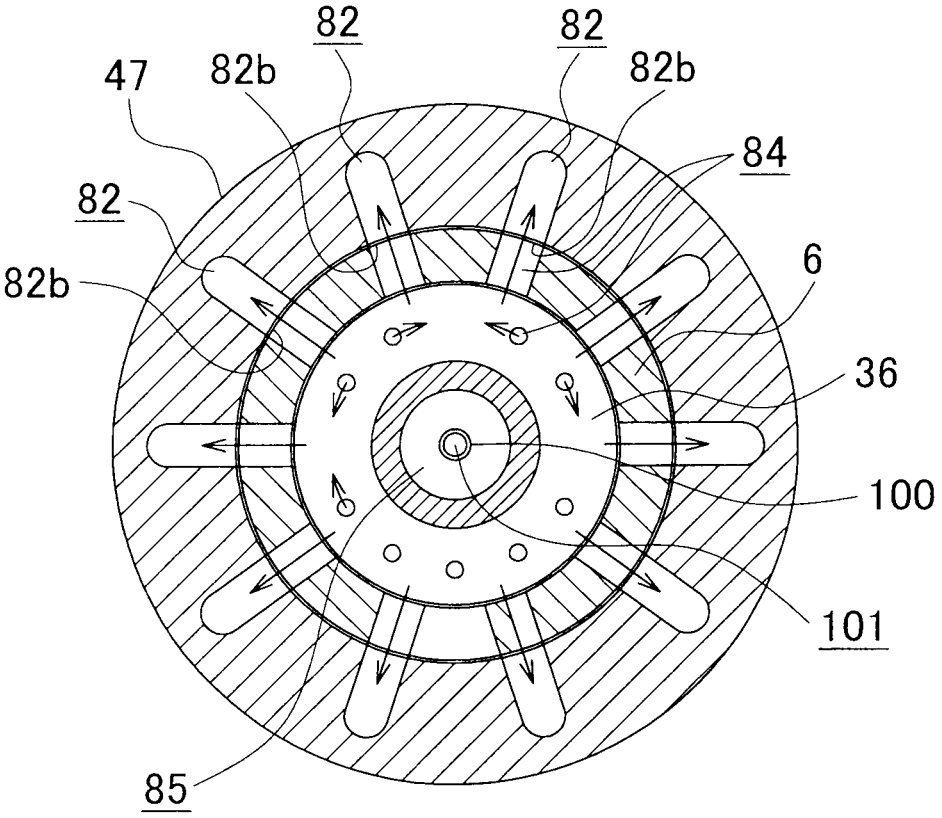
FIG. 9 is a horizontal cross-sectional view showing a cross section taken along line IX-IX of FIG. 4.

As shown in FIGS. 4 and 5, in the cylinder body 40 twelve cylinder chambers 41 are formed at equal intervals in a circumferential direction, and each of the cylinder chambers 41 is provided with the piston 14. Oil paths 81 are formed in the cylinder body 40. Each of the oil paths 81 has an opening 81*a* communicated with each cylinder chamber 41 and opened in the axial direction. As shown in FIG. 4 and FIGS. 6 to 9, ten suction ports 82 and ten discharge ports 83 are formed alternately at equal intervals along the circumferential direction in the rotary valve 47. In this embodiment, each of the cam surfaces 52, 54, 56 has ten concave parts and convex parts, the numbers of which correspond to the numbers of the suction ports 82 and discharge ports 83. Each of the suction ports 82 has an opening 82*a* opened in the axial direction and an opening 82*b* opened in the radial direction. Each of the discharge ports 83 also has an opening 83*a* opened in the axial direction and an opening 83*b* opened in the radial direction. The opening 82*a* of the suction port 82 and the opening 83*a* of the discharge port 83 are disposed in the same position as the opening 81*a* of the oil path 81 of the cylinder body 40 with respect to the radial direction so as to be communicated with the opening 81*a*. As is clear from the FIGS. 4, 7 and 9, the opening 82*b* of the suction port 82 and the opening 83*b* of the discharge port are disposed in different position with respect to the axial direction. Specifically, the opening 82*b* of the suction port 82 is provided in a position where the opening port 82*b* can be communicated with suction paths 84 formed in the guide piece 36 and the input shaft 6, while the opening 83*b* of the discharge port 83 is provided in a position where the opening port 83*b* can be communicated with discharge paths 85 formed in the input shaft 6 and the guide piece 36.

Because the suction ports 82 of the rotary valve 47 are communicated with the suction path 84 and the discharge ports 83 are communicated with the discharge paths 85 as described above, when the cylinder body 40 rotates relative to the rotary valve 47 in accordance with a rotational difference between the cylinder body 40 and the cam unit 13, the ports that are communicated with the openings 81*a* of the oil path 81 of the cylinder body 40 are sequentially changed over between the suction ports 82 and the discharge ports 83. Therefore, the oil is guided to the cylinder chambers 41 through the suction paths 84 and the suction ports 82 when the cylinder chambers 41 is in a suction stroke, and the oil of the cylinder chambers 41 is discharged through the discharge ports 83 and the discharge paths 85 when the cylinder chambers 41 are in the discharge stroke.

Figure 10:
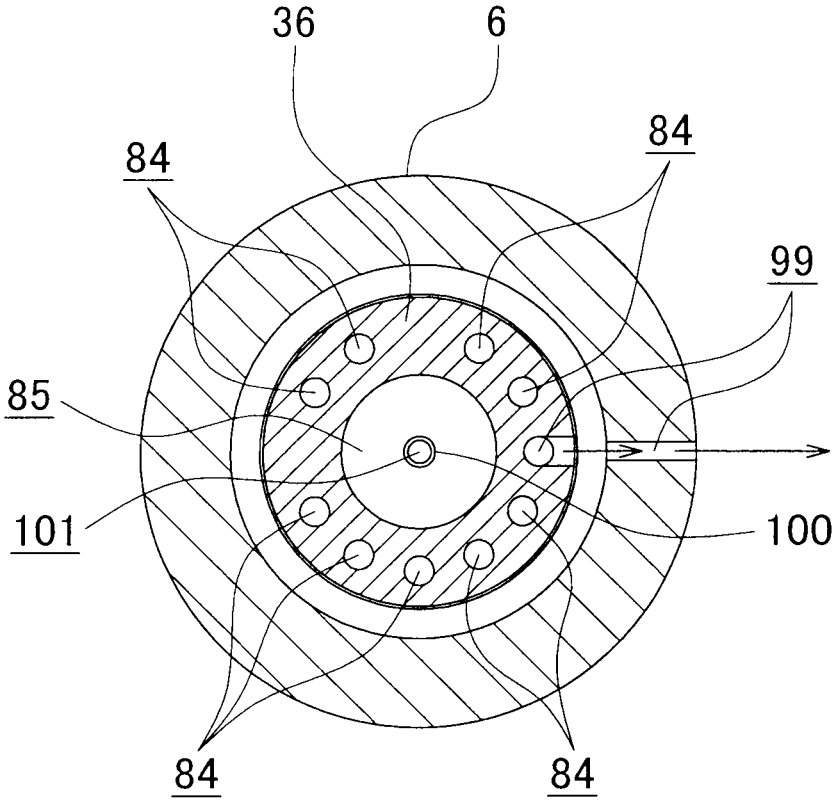
FIG. 10 is a horizontal cross-sectional view showing a cross section taken along line X-X of FIG. 4.
Figure 11:
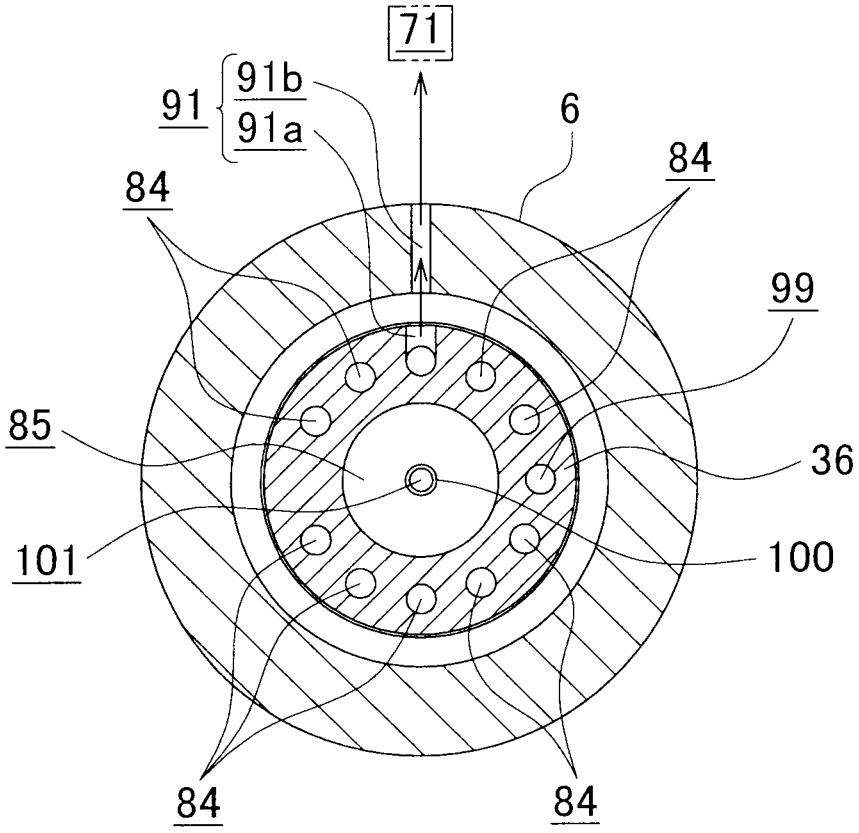
FIG. 11 is a horizontal cross-sectional view showing a cross section taken along line XI-XI of FIG. 4.
Figure 12:
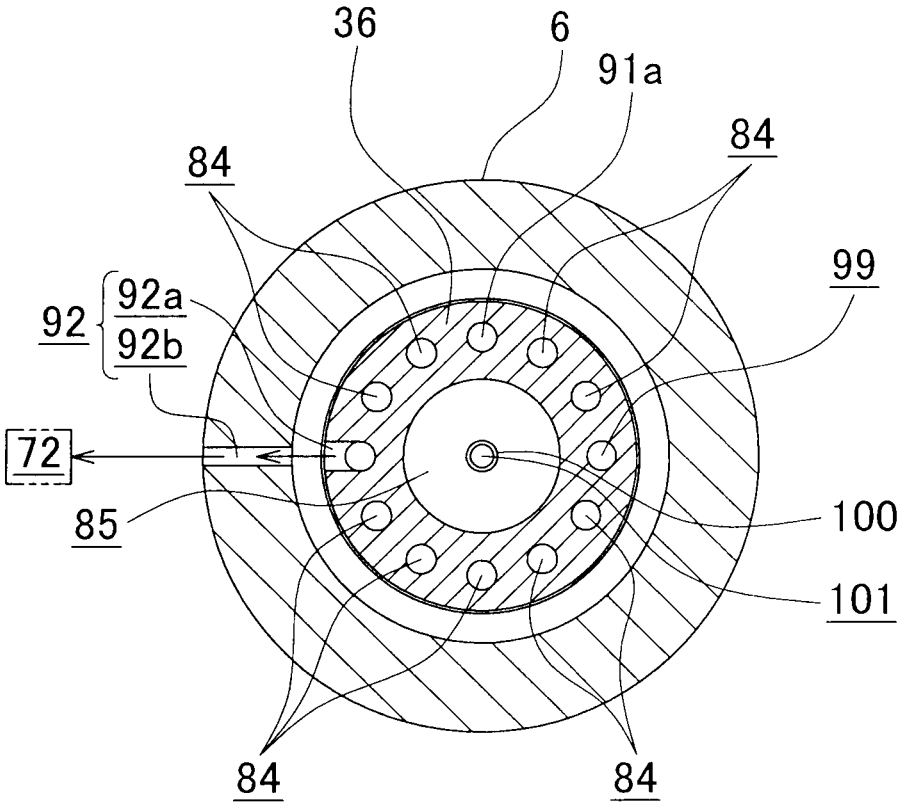
FIG. 12 is a horizontal cross-sectional view showing a cross section taken along line XII-XII of FIG. 4.

Next, a flow of the oil in the moving device 57 is described. As shown in FIG. 4 and FIGS. 10 to 12, the moving device 57 is further provided with a first introduction path 91 for guiding the lubricant oil to the first control chamber 71, and a second introduction path 92 for guiding the lubricant oil to the second control chamber 72. As shown in FIGS. 4 and 11, the first introduction path 91 has a vertical path 91*a* that is formed in the guide piece 36 and extends in the axial direction, and a horizontal path 91*b* that extends in the radial direction and is communicated with the vertical path 91*a* and the first control chamber 71. The vertical path 91*a* is opened at a left end of the guide piece 36 and communicated with a first control path 93 formed on an inner surface of the pump housing 30. The horizontal path 91*b* is formed in the guide piece 36 and the input shaft 6. On the other hand, the second introduction path 92 has a horizontal path 92*a* that is formed in the guide piece 36 and extends in the axial direction, and a horizontal path 92*b* that extends in the radial direction and is communicated with the horizontal path 92*a* and the second control chamber 72, as shown in FIGS. 4 and 12. The horizontal path 92*a* is opened at the left end of the guide piece 36 and communicated with a second control path 94 formed on the inner surface of the pump housing 30. Note that the opened positions of the vertical path 92*a* of the second introduction path 92 and of the vertical path 91*a* of the first introduction path 91 at the left end of the guide piece 36 are different with respect to the circumferential direction, and these vertical paths 91*a*, 92*a* are communicated with the first and second control paths 93, 94 while being sealed by sealing means such as an O-ring. As a result, the vertical path 91*a* of the first introduction path 91 is communicated only with the first control path 93, and the vertical path 92*a* of the second introduction path 92 is communicated only with the second control path 94.

As shown in FIGS. 1 and 4, the oil pressure regulator 73 has a first control valve 96 and second control valve 97 for independently regulating the hydraulic pressure of the first control path 93 and the hydraulic pressure of the second control path 94. The first control valve 96 is capable of changing over between a state that allows the communication between the first control path 93 and the discharge paths 85 and a state that opens the first control path 93 to an oil pan 115 (FIG. 1). The second control valve 97 is capable of changing over between a state that allows the communication between the second control path 94 and the discharge paths 85 and a state that opens the second control path 94 to the oil pan. Therefore, then the first control path 93 is communicated with the oil paths 85 by the first control valve 96, the hydraulic pressure of the first control path 93 increases and the first introduction path 91 and the first control chamber 71 become filled with the oil. As a result, the capacity of the first control chamber 71 increases and the first movable cam member 53 is restrained to an effective position (see the section above the axis Ax1 shown in FIGS. 2 and 3). This state corresponds to a restrained state associated with the invention. When, on the other hand, the first control path 93 is opened to the oil pan 115 by the first control valve 96, the hydraulic pressure of the first control path 93 decreases. As a result, the hydraulic pressure of the first control chamber 71 decreases and the first movable cam member 53 restrained to the effective position thereof is released (see the section below the axis Ax1 shown in FIGS. 2 and 3). This state corresponds to a release state associated with the invention. In the second control path 94 as well, when the second control path 94 and the discharge paths 85 are communicated with each other by the second control valve 97, the hydraulic pressure of the second control path 94 increases and the second introduction path 92 and the second control chamber 72 become filled with the oil. As a result, the capacity of the second control chamber 72 increases and the second movable cam member 55 is restrained to the effective position (see the section above the axis Ax1 shown in FIGS. 2 and 3). When, on the other hand, the second control path 94 is opened to the oil pan 115 by the second control valve 97, the hydraulic pressure of the second control path 94 decreases. As a result, the hydraulic pressure of the second control chamber 72 decreases and the second movable cam member 55 restrained to the effective position thereof is released (see the section below the axis Ax1 shown in FIGS. 2 and 3).

Therefore, by opening the first control path 93 and the second control path 94 to the oil pan 115 by means of the first control valve 96 and the second control valve 97, the fixed cam member 51 shown in FIGS. 2 and 3 is made effective. Moreover, by allowing the first control path 93 and the discharge paths 85 to be communicated with each other by means of the first control valve 96 and opening the second control path 94 to the oil pan 115 by means of the second control valve 97, the first movable cam member 53 is made effective. In addition, by opening the first control path 93 to the oil pan 115 by means of the first control valve 96 and allowing the second control path 94 and the discharge paths 85 to be communicated with each other by means of the second control valve 97, the second movable cam member 55 is made effective. Note in the embodiment shown in FIG. 3 that the position of the lowermost part 56*b* of the cam surface 56 of the restrained second movable cam member 55 is set at the position same as or forward of the position of the lowermost part 54*b* of the cam surface 54 of the restrained first movable cam member 53. For this reason, by allowing the first control path 93 and the second control path 94 to be communicated with the discharge paths 85 by means of the first control valve 96 and the second control valve 97, the second movable cam member 55 can be made effective. Therefore, for example, by allowing the second control path 94 and the discharge paths 85 to be communicated with each other by means of the second control valve 97 while keeping the first movable cam member 53 effective, the second movable cam member 55 is made effective. As a result, it becomes possible to readily control the transition of changing over the operation of making these movable cam members 53, 55 effective.

When changing over between the cams to be made effective, the piston 14 is inhibited from stroking along the cam surfaces of at least two cams in the course of the changing over. Therefore, the fixed cam member 51, the first movable cam member 53 and the second movable cam member 55 shown in FIG. 2 are configured such that the axial rigidities of the movable cam members 53, 55 are lower than the axial rigidity of the fixed cam member 51. Axial rigidity means the degree of change in the dimensions of the cam members 51, 53, 55 in the axial direction, the change being caused by the load of the piston 14. Specifically, the movable cam members 53, 55 illustrated in the embodiment are configured such that the degree of change in the dimension of each of the movable cam members 53, 55 is greater than that of the fixed cam member 51. More specifically, the cam members 51, 53, 55 are configured as follows.

As shown in FIG. 2, the first movable cam member 53 has a load bearing part 53*a* that bears the loads of the piston 14 and of the first control chamber 71. The load bearing part 53*a* is made of a material having a Young's modulus lower than that of a load bearing part 51*a* of the fixed cam member 51. The load bearing part 51*a* bears the loads of the piston 14 and of the projecting part 6*a* of the input shaft 6 (bearing reaction force). Also, the first movable cam member 53 is configured such that the axial thickness of the load bearing part 53*a* is made thicker than the axial thickness of the load bearing part 51*a* of the fixed cam member 51. Moreover, the first movable cam member 53 is configured such that the moment arm of the load bearing part 53*a* is made longer than the moment arm of the load bearing part 51*a* of the fixed cam member 51. The moment arm of the load bearing part 53*a* is equivalent to the distance in the radial direction between the first control chamber 71 and the cam surface 54, while the moment arm of the load bearing part 51*a* is equivalent to the distance in the radial direction between the projecting part 6*a* and the cam surface 52. In this way, the first movable cam member 53 is configured to have rigidity lower than that of the fixed cam member 51. Note that, as another embodiment, at least one of the means for reducing the Young's modulus, reducing the thickness and increasing the moment arm of the material of the first movable cam member 53 in relation to the fixed cam member 51 can be performed on the first movable cam member 53 to reduce the rigidity of the first movable cam member 53 lower than the rigidity of the fixed cam member 51.

The second movable cam member 55 has a load bearing part 55*a* for bearing the loads of the piston 14 and of the second control chamber 72. The load bearing part 55*a* is made of a material having a Young's modulus lower than that of the load bearing part 51*a* of the fixed cam member 51. Therefore, the second movable cam member 55 is configured to have rigidity lower than that of the fixed cam member 51. Note that, as with the case described above, at least one of the means for reducing the axial thickness of the load bearing part 55*a* more than the axial thickness of the load bearing part 51*a* and increasing the moment arm of the load bearing part 55*a* more than the moment arm of the load bearing part 51*a* can be performed on the second movable cam member 55 to reduce the rigidity of the second movable cam member 55 lower than the rigidity of the fixed cam member 51.

Because the piston 14 is inhibited from stroking along the cam surfaces of at least two cams in the course of changing over between the cams to be made effective, fluctuation of the hydraulic pressure of the cylinder 41 can be prevented.

Since the first control chamber 71 and the second control chamber 72 are configured to rotate integrally with the input shaft 6 as shown in FIG. 2, rotation of the input shaft 6 generates centrifugal force in the oil of the first control chamber 71 and the second control chamber 72, generating centrifugal hydraulic pressure. Therefore, the moving device 57 further has a first canceling chamber 75 and second canceling chamber 76 for preventing the first movable cam member 53 and the second movable cam member 55 from being moved by this centrifugal hydraulic pressure against a control command. The oil is supplied to the first canceling chamber 75 and the second canceling chamber 76 by the guide piece 36 and a canceling path 99 formed on the input shaft 6 as shown in FIGS. 4 and 10.

Returning to FIG. 1, control of each part of the power transmission device 4 is now described. The power transmission device 4 is controlled by the ECU 110 and the hydraulic control device 120. Various parameters that reflect the operational state of the internal combustion engine 2 and the traveling condition of the vehicle 1 are input to the ECU 110. For example, rotational speed of the internal combustion engine 2 is input from a crank angle sensor 111 and traveling speed of the vehicle 1 is input from a vehicle speed sensor 112. Based on these parameters, the ECU 110 outputs a signal for controlling the internal combustion engine 2 and a signal for controlling the hydraulic control device 120. In addition to the oil pressure regulator 73 having the first control valve 96 and the second control valve 97, the hydraulic control device 120 is further provided with a flow regulating valve 113 and the like as described hereinafter. The hydraulic control device 120 controls these valves based on the output signals from the ECU 110 and thereby control the operations of the pump 7 of the power transmission device 4, the forward/reverse change-over device 8, and the continuously variable transmission 9.

With respect to the operational control of the pump 7, the hydraulic control device 120 controls the first control valve 96 and the second control valve 97 shown in FIG. 4 on the basis of the output signals from the ECU 110, and thereby selects a cam member suitable to the situation. For example, by controlling the first control valve 96 and the second control valve 97 depending on the load of the internal combustion engine 2 while the vehicle 1 is traveling, the fixed cam member 51, the first movable cam member 53 and the second movable cam member 55 are used separately. As a result, the capacity of the pump 7 can be changed according to the operational state of the internal combustion engine 2 and the traveling condition of the vehicle 1 and the loss of energy in the pump 7 can be reduced. Also, due to a significant difference between the rotational speed of the input shaft 6 coupled to the internal combustion engine 2 and the rotational speed of the connecting drum 15 coupled to the drive wheel 12 when the vehicle 1 is started (rotational difference), the flow rate of the oil suctioned into the cylinder chamber 41 increases and accordingly the suction resistance of the oil increases, which easily impedes the roller 50 from following the cam surface. Even in such a situation, the flow rate of the oil can be prevented from increases and followability of the roller 50 relative to the cam surface can be secured, by making the fixed cam member 51 having a small lifted amount effective. Moreover, when it is difficult to obtain sufficient hydraulic pressure immediately after starting up the engine, the rotational difference between the input shaft 6 and the connecting drum 15 is significant when the vehicle is stopped. However, in the case where the hydraulic pressure is not supplied to the first control chamber 71 and the second control chamber 72, the fixed cam member 51 with a small lifted amount is made effective automatically. Consequently, the followability of the roller 50 relative to the cam surface can be secured even in such a situation.

As shown in FIG. 1, the discharge path 85 of the pump 7 is provided with the regulating valve 113 for regulating the flow rate of the oil to be discharged from the pump 7. Upon startup of the vehicle 1, the flow rate regulating valve 113 is operated to regulate the flow rate of the oil discharged from the pump 7 so that the rotational speed of the output side of the pump 7, i.e., the connecting drum 15, can be controlled. In this manner, the pump 7 can be caused to function as a starting device.

The forward/reverse change-over device 8 and the continuously variable transmission 9 are controlled in the same manner as in the related art. Specifically, with regard to the control of the forward/reverse change-over device 8, the ECU 110 detects a forward or reverse request based on a signal from a shift position sensor (not shown) for detecting the position of the shift lever of the vehicle 1, and controls the clutch 20 and the braking device 21 to realize the request. With regard to the control of the continuously variable transmission 9, the ECU 110 controls the groove widths of the primary pulley 23 and secondary pulley 25 so as to obtain an appropriate transmission gear ratio proportionate to the rotational speed of the internal combustion engine 2 and the vehicle speed of the vehicle 1.

The invention is not limited to the embodiment described above, and thus various types of modifications are possible within the scope of the invention. The power transmission device is not the only subject of application of the pump according to the embodiment of the invention. Therefore, the pump according to the invention may be used for various purposes. Although the cam unit 13 is provided on the input side and the cylinder body 40 (piston 14) on the output side in the embodiment described above, the invention can be implemented in an embodiment in which the cam unit 13 is provided on the output side and the cylinder body 40 (piston 14).

In addition, the two movable cam members 53, 55 were described as an example of the movable cam members according to the invention, but there is no limit on the number of the movable cam members. Therefore, the invention can be implemented as a pump having one or three or more movable cam members.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single elements, are also within the spirit and scope of the invention.

What is claimed is:

1. An axial piston pump that generates hydraulic pressure by means of rotational power input from a drive shaft, the axial piston pump comprising:

a cylinder body that forms therein a cylinder chamber extending in an axial direction of the drive shaft and rotates integrally with a driven shaft;

a piston that is inserted into the cylinder chamber and reciprocates in the axial direction of the drive shaft in the cylinder chamber; and a cam device that rotates integrally with the drive shaft and has:

a fixed cam member that has a cam surface capable of coming into contact with a cam follower coupled to the piston and rotates integrally with the drive shaft, with movement of the fixed cam member in the axial direction being restricted; and a movable cam member that has a cam surface capable of coming into contact with the cam follower and rotates integrally with the drive shaft, with movement of the movable cam member in the axial direction being allowed, an irregularity difference in the axial direction of the cam surface of the fixed cam member and an irregularity difference in the axial direction of the cam surface of the movable cam member being different from each other, wherein the fixed cam member and the movable cam member are disposed coaxially with the fixed cam member disposed on an innermost side, and an inner circumferential surface of the movable cam member is spline-coupled to an outer circumferential surface of the fixed cam member.

2. The axial piston pump according to claim 1, wherein, in the cam device, the irregularity difference of the cam surface of the fixed cam member is smaller than the irregularity difference of the cam surface of the movable cam member.

3. The axial piston pump according to claim 2, wherein the cam device further has a cam effecting device that changes over between a restrained state where the movable cam member is restrained to an effective position with respect to the axial direction, in which the cam follower is capable of following the cam surface of the movable cam member, and a release state where the restraint of the movable cam member to the effective position is released.

4. The axial piston pump according to claim 3, wherein the cam effecting device has a control chamber to which fluid is guided in order to move and restrain the movable cam member to the effective position, and a pressure regulating part capable regulating pressure within the control chamber so as to change over the movable cam member between the restrained state and the release state, the pressure regulating part using fluid discharged from the cylinder chamber to regulate the pressure within the control chamber.

5. The axial piston pump according to claim 3, wherein the cam effecting device further has a stopper for regulating a movement of the movable cam member so that a position of a lowermost part of the cam surface of the movable cam member restrained to the effective position is aligned with a position of a lowermost part of the cam surface of the fixed cam member or reaches a position closer to the piston than the position of the lowermost part of the fixed cam member.

6. The axial piston pump according to claim 3, wherein axial rigidity of the movable cam member is lower than axial rigidity of the fixed cam member.

7. The axial piston pump according to claim 6, wherein a moment arm of a load bearing part of the movable cam member is longer than a moment arm in the axial direction of a load bearing part of the fixed cam member.

8. The axial piston pump according to claim 6, wherein a Young's modulus of a material forming the movable cam member is lower than a Young's modulus of a material forming the fixed cam member.

9. The axial piston pump according to claim 6, wherein axial thickness of the load bearing part of the movable cam member is thinner than axial thickness of the load bearing part of the fixed cam member.

10. The axial piston pump according to claim 1, wherein the cam device further has a cam effecting device that changes over between a restrained state where the movable cam member is restrained to an effective position with respect to the axial direction, in which the cam follower is capable of following the cam surface of the movable cam member, and a release state where the restraint of the movable cam member to the effective position is released.

11. The axial piston pump according to claim 10, wherein the cam effecting device has a control chamber to which fluid is guided in order to move and restrain the movable cam member to the effective position, and a pressure regulating part capable regulating pressure within the control chamber so as to change over the movable cam member between the restrained state and the release state, the pressure regulating part using fluid discharged from the cylinder chamber to regulate the pressure within the control chamber.

12. The axial piston pump according to claim 10, wherein the cam effecting device further has a stopper for regulating a movement of the movable cam member so that a position of a lowermost part of the cam surface of the movable cam member restrained to the effective position is aligned with a position of a lowermost part of the cam surface of the fixed cam member or reaches a position closer to the piston than the position of the lowermost part of the fixed cam member.

13. The axial piston pump according to claim 10, wherein axial rigidity of the movable cam member is lower than axial rigidity of the fixed cam member.

14. The axial piston pump according to claim 13, wherein a moment arm of a load bearing part of the movable cam member is longer than a moment arm in the axial direction of a load bearing part of the fixed cam member.

15. The axial piston pump according to claim 13, wherein a Young's modulus of a material forming the movable cam member is lower than a Young's modulus of a material forming the fixed cam member.

16. The axial piston pump according to claim 13, wherein axial thickness of the load bearing part of the movable cam member is thinner than axial thickness of the load bearing part of the fixed cam member.

17. A power transmission device that is provided within a power transmission path between a power source for traveling of a vehicle and a drive wheel, the power transmission device comprising:

a drive shaft to which one of an output side and an input side of the power transmission path is connected;

a driven shaft that is disposed coaxially with the drive shaft, and to which the other one of the output side and input side of the power transmission path is connected;

a cam device that rotates integrally with the drive shaft;

a cylinder body that forms therein a cylinder chamber extending in an axial direction of the drive shaft and rotates integrally with the driven shaft;

a piston that is inserted into the cylinder chamber and reciprocates; and an axial piston pump that is capable of reciprocating the piston in the axial direction by means of the cam device and discharging fluid suctioned into the cylinder chamber from the cylinder chamber, wherein the cam device has:

a fixed cam member that has a cam surface capable of coming into contact with a cam follower coupled to the piston and is capable of rotating integrally with the drive shaft, with movement of the fixed cam member in the axial direction being restricted;

a movable cam member that has a cam surface capable of coming into contact with the cam follower and is capable of rotating integrally with the drive shaft, with movement of the movable cam member in the axial direction being allowed; and a cam effecting device that uses the fluid discharged from the cylinder chamber to change over between a restrained state where the movable cam member is restrained to an effective position with respect to the axial direction, in which the cam follower is capable of following the cam surface of the movable cam member, and a release state where the restraint of the movable cam member to the effective position is released, an irregularity difference in the axial direction of the cam surface of the fixed cam member being smaller than an irregularity difference in the axial direction of the cam surface of the movable cam member, and wherein the fixed cam member and the movable cam member are disposed coaxially with the fixed cam member disposed on an innermost side, and an inner circumferential surface of the movable cam member is spline-coupled to an outer circumferential surface of the fixed cam member.

18. The power transmission device according to claim 17, further comprising:

a continuously variable transmission that is provided in the power transmission path and has a belt.

19. The power transmission device according to claim 18, further comprising:

a regulating device that regulates a flow rate of the fluid discharged from the cylinder chamber; and a control device that controls the regulating device on the basis of an operational state of the power source for traveling and a traveling state of the vehicle.

20. The power transmission device according to claim 17, further comprising:

a regulating device that regulates a flow rate of the fluid discharged from the cylinder chamber; and a control device that controls the regulating device on the basis of an operational state of the power source for traveling and a traveling state of the vehicle.

* * * * *

UNITED STATES PATENT AND TRADEMARK OFFICE

CERTIFICATE OF CORRECTION

PATENT NO. : 8,523,536 B2
APPLICATION NO. : 12/201113
DATED : September 3, 2013
INVENTOR(S) : Shinya Kuwabara et al.

It is certified that error appears in the above-identified patent and that said Letters Patent is hereby corrected as shown below:

On the title page, Item (75), the 3rd Inventor's Last Name is incorrect. Item (75) should read:

--(75) Inventors: Shinya Kuwabara, Susono (JP);
Tadashi Fujiyoshi, Susono (JP);
Hiroyuki Shioiri, Susono (JP)--

Signed and Sealed this
Twenty-ninth Day of October, 2013

Teresa Stanek Rea
*Deputy Director of the United States Patent and Trademark Office*